United States Patent [19]

Shoda

[11] 4,244,408

[45] Jan. 13, 1981

[54] UTILITY BAG

[75] Inventor: Otome Shoda, Funabashi, Japan

[73] Assignee: Yamatoya Company Limited, Japan

[21] Appl. No.: 973,803

[22] Filed: Dec. 28, 1978

[51] Int. Cl.[3] ..... A45C 7/00

[52] U.S. Cl. ..... 150/1.7; 150/12; 190/44

[58] Field of Search ..... 150/1.7, 12, 33; 190/44; 229/54 R

[56] References Cited

U.S. PATENT DOCUMENTS

| | | | |
|---|---|---|---|
| 1,815,106 | 7/1931 | Jostes | 150/1.7 X |
| 2,078,624 | 4/1937 | Wolff | 150/1.7 |
| 2,532,778 | 12/1950 | Mintzes | 150/1.7 |
| 3,358,904 | 12/1967 | Van Houtte | 150/12 X |

*Primary Examiner*—Donald F. Norton

*Attorney, Agent, or Firm*—McGlew and Tuttle

[57] ABSTRACT

A utility bag or pouch having a body for holding articles and a pair of grips provided on said body, which comprises said body and grips being formed of a single continuous piece of cloth, said piece of cloth being cut into a predetermined shape so that it has portions corresponding to the front and rear sides of said body and pairs of extensions corresponding to said grips formed integrally with said portions corresponding to the front and rear sides of said body by cutting the central areas of the grip portions of said bag or pouch into a U shape, each of which being provided symmetrically with respect to a portion corresponding to the bottom side of said body—or the top edge portions of said grips—, the right and left edges of said portions corresponding to the front and rear sides of said body being sewn together respectively and the top edges of said extensions—or the bottom edges of said portions corresponding to the front and rear sides of said body—being sewn together respectively so as to form said body and grips integrally with each other, and said body having a means for adjusting the capacity thereof.

6 Claims, 8 Drawing Figures

UTILITY BAG

BACKGROUND OF THE INVENTION

1. Field of the Invention

The present invention relates, in general, to a utility bag or pouch and, more particularly, to a folding utility bag or pouch of nylon cloth, vinyl sheet, leather or the like which is handy to carry and whose capacity can be easily adjusted according to the amount of things it is to hold.

2. Prior Art

Heretofore, various kinds of utility bags or pouches of cloth or the like have been proposed, which, when not in use can be folded up into a compact form so as to be convenient to carry, and when in use can be adjusted in capacity according to the amount of things they hold by operating slide fasteners, buttons or the like. In producing any of these bags or pouches, it is necessary to cut a cloth into several pieces corresponding to the front, rear, right, left and bottom sides of the article-holding section, to sew these pieces of cloth together into a desired shape, to sew slide fasteners into the seams as necessary, and to separately attach grips to the body of the bag or pouch, or the article-holding section, by means of sewing-threads or fittings. The conventional utility bag or pouch produced in such a manner has the following disadvantages:

When carried with heavy articles therein, it is liable to be broken at the portions where the grips join with the body, because all the loads are inherently supported thereat. In addition, the production process which sews several pieces of cloth together is relatively complex considering the simplicity of the utility bag or pouch, causing the production cost to increase. Therefore, this production cost is not suitable for the production of the utility bag or pouch that should be inexpensive.

SUMMARY OF THE INVENTION

To eliminate the above-mentioned disadvantages of the prior art, it is an object of the present invention to provide a utility bag or pouch which can be produced in a simplified process performed by sewing a single continuous piece of cloth cut into a predetermined shape.

Accordingly, it is an object of the invention to provide a utility bag for holding articles comprising a sheet of material including a first side wall and a second side wall, each side wall having a bottom edge and two side edges, the first and second side wall being in juxtaposition, a lower part of each side edge of the first side wall being sewably connected to a substantially equal length of a juxtaposed lower part of each side edge of the second side wall, a remaining upper part of each side edge of the first and second side walls being disposed adjacent to a portion of the material, the material having a cutout centrally disposed between the material portions, at least two of the material portions being connected to each other forming loops defining hand grip areas, a plurality of tapes, each of said tapes having an interlockable member sewn to a respective one of the side walls, means connected to at least one of the members for interlocking both members, and an integral part of the material disposed between the tapes providing means for adjusting the capacity of the bag.

A further object of the invention is to provide a bag forming blank comprising a single sheet of material having a first side wall forming panel and a second side wall forming panel, the first panel being integrally interconnected to the second panel, each of the panels having an end edge and two side edges, the material having at least one cutout centrally disposed intermediate side portions of the material adjacent to the side edges and at least one end portion of the material adjacent to one of the end edges, the side portions of material defining handle grip forming members, zipper means sewn to at least one of the panels, said blank being adapted to be converted into a bag having a body for holding articles and a pair of integral handle grips by folding the sheet, juxtaposing the side wall forming panels, sewing together parts of the juxtaposed side wall forming panels not adjacent to the side material portions and sewing together at least part of the side material portions.

It is another object of the present invention to provide a utility bag or pouch which is low in production cost, strong, durable, handy to carry, and convenient for use.

It is a further object of the present invention to provide a utility bag or pouch to which slide fasterners and the like for controlling the capacity thereof according to the size of things it holds can be easily attached when being produced.

It is a still further object of the present invention to provide a utility bag or pouch which can easily obtain varied forms suitable for satisfying a sense of beauty becoming to one of personal effects.

According to the present invention, there is provided a utility bag or pouch having a body (or a article-holding section) and a pair of grips provided on said body, which comprises said body and grips being formed of a single continuous piece of cloth or the like, said piece of cloth being cut into a predetermined shape so that it has portions corresponding to the front and rear sides of said body and pairs of extensions corresponding to said grips formed integrally with said portions corresponding to the front and rear sides of said body by cutting the central areas of the grip portions of said bag or pouch into a U shape, each of which being provided symmetrically with respect to a portion corresponding to the bottom side of said body—or the top edge portions of said grips—, the right and left edges of said portions corresponding to the front and rear sides of said body being sewn together respectively and the top edges of said extensions—or the bottom edges of said portions corresponding to the front and rear sides of said body—being sewn together respectively so as to form said body and grips integrally with each other, and said body having a means for adjusting the capacity thereof.

The means for adjusting the capacity of the body may be a slide fastener provided as follows:

A pair of tapes having interlocking teeth for a slide fastener are sewn directly on the surface of the cloth at the bottom side portion of the body and symmetrically with respect to the center line of the bottom side portion of the body in the longitudinal direction throughout the entire length so that they are spaced apart by a predetermined distance and provided parallel with each other throughout substantially the entire length except the both ends. They are adapted to engage with and disengage from each other to adjust or control the capacity of the bag or pouch. In another example, a pair of parallel tapes having interlocking teeth for a slide fastener and spaced apart by a predetermined distance may be sewn directly on the surface of the cloth along the longitudinal direction of the central portion of the body throughout substantially the entire length from the front side to the rear side through the bottom portion. In this example, the capacity of the bag or pouch can be adjusted in the same manner as mentioned above.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
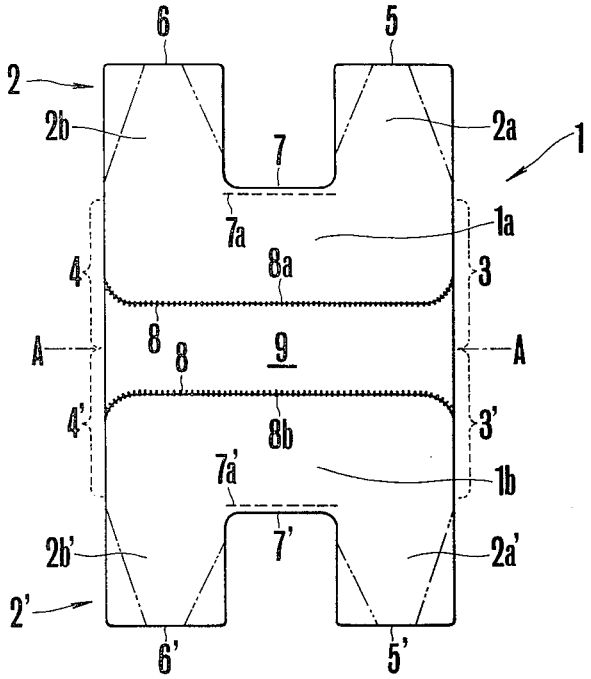
FIG. 1 is a schematical development of a single continuous piece of cloth cut into a predetermined shape to form a utility bag or pouch according to an embodiment of the present invention, showing the condition before sewing.
Figure 2:
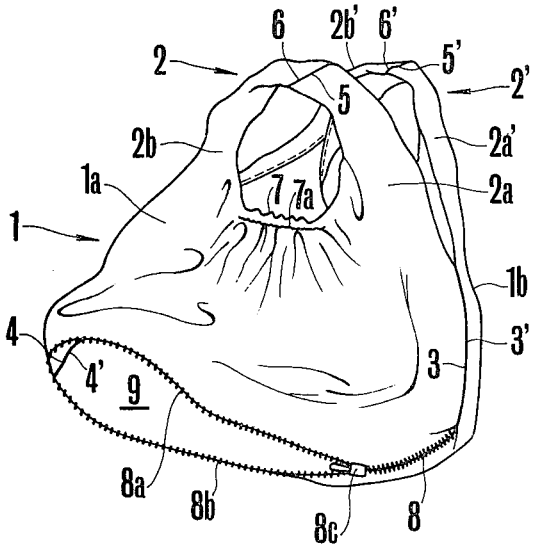
FIG. 2 is a perspective view of a utility bag or pouch formed by sewing the material shown in FIG. 1, showing the slide fastener as it appear when half opened.
Figure 2A:
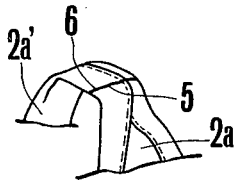
FIG. 2*a* is a perspective view showing the reversed side of the grip of the bag or pouch shown in FIG. 2 in order to illustrate the sewing condition of the rear surface.

Reference is now made to FIGS. 1, 2 and 2*a* concerning a preferred embodiment of the present invention. As shown in FIG. 1, a single continuous seamless piece of cloth made of nylon or the like is cut into a predetermined shape so that it has portions corresponding to the front side 1*a* and rear side 1*b* of the body 1 and pairs of extensions 2*a*, 2*b* and 2*a*', 2*b*' corresponding respectively to grips 2 and 2' formed integrally with the portions 1*a* and 1*b* respectively by cutting the central areas of the grip portions of said cloth into a U shape, each of which being provided symmetrically with respect to the line A—A on the portion corresponding to the bottom side of the pouch. The front side portion 1*a*, rear side portion 1*b*, grip portions 2 and 2' thus provided symmetrically with respect to the line A—A are folded back with their front surfaces facing each other (i.e., with the rear surfaces of the portions 1*a* and 1*b* facing outward). Thus the side edge 3 of the front side portion 1*a* and the side edge 3' of the rear side portion 1*b* are sewn together, and the side edge 4 of the front side portion 1*a* and the side edge 4' of the rear side portion 1*b* are also sewn together. Then, the top edge 5 of the extension 2*a* and the top edge 6 of the extension 2*b* may be sewn to the top edge 5' of the extension 2*a*' and the top edge 6' of the extension 2*b*', respectively or, as shown in FIG. 2, the top edge 5 and the top edge 5' may be sewn to the top edge 6 and 6', respectively.

Prior to the above process, margins to sew up are provided at the edges of the cloth except the above seams as a matter of course. Elastic cords 7*a* and 7*a*' are preferably sewn in the bottom edge portions 7 and 7' (i.e., the bottom edges of the opening of the pouch) of the U-shaped cuts, respectively, thereby causing the bottom edges of the opening to be normally shrunk.

In order to increase the handiness and strength of the grips 2 and 2', they may be sewn in the following manner:

The extensions 2*a*, 2*a*', 2*b* and 2*b*' are folded back inward from the dot-dash lines shown in FIG. 1, and then the top edges 5, 5', 6 and 6' are sewn together as mentioned above. FIG. 2*a* shows the reversed side of the grip, illustrating the sewing conditions at the grip.

Prior to sewing of the edges 3, 3' and 4, 4' of the front side portion 1*a* and rear side portion 1*b*, in this embodiment, a pair of tapes 8*a* and 8*b* having interlocking teeth for a slide fastener 8 are sewn directly on the surface of the cloth with the line A—A therebetween so that they are spaced apart by a predetermined distance and provided parallel with each other throughout substantially the entire length except the both ends for connection. The tapes 8*a* and 8*b* of the slide fastener 8 may be engaged with each other by a slider 8*c*, after completion of the bag,by folding inward a portion 9 between the tapes 8*a* and 8*b* provided on the bottom side of the body 1, as a matter of course.

After completion of sewing of the fastener 8, sewing of the front side 1*a* and rear side 1*b* with the rear surfaces thereof facing outward, and sewing of elastic cords 7*a* and 7*b* in the body as mentioned above, the entire body is reversed so that the front surfaces of the front and rear sides 1*a* and 1*b* and those of the grips 2 and 2' face outward and the fastener 8 is made to close (in a half-open state, in FIG. 2). Thus the utility bag or pouch of the present invention is formed as shown in FIG. 2.

Figure 4:
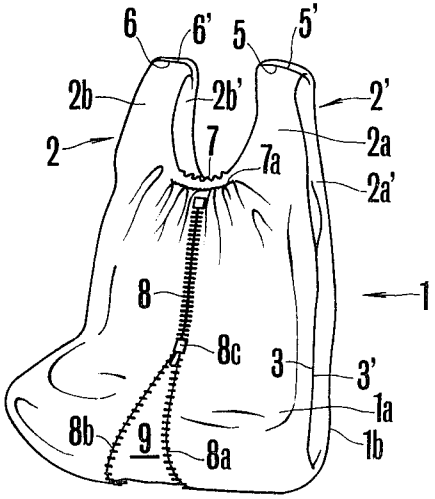
FIG. 4 is a perspective view of a utility bag or pouch formed by sewing the material shown in FIG. 3, showing the slide fastener as it appear when half opened.
Figure 3:
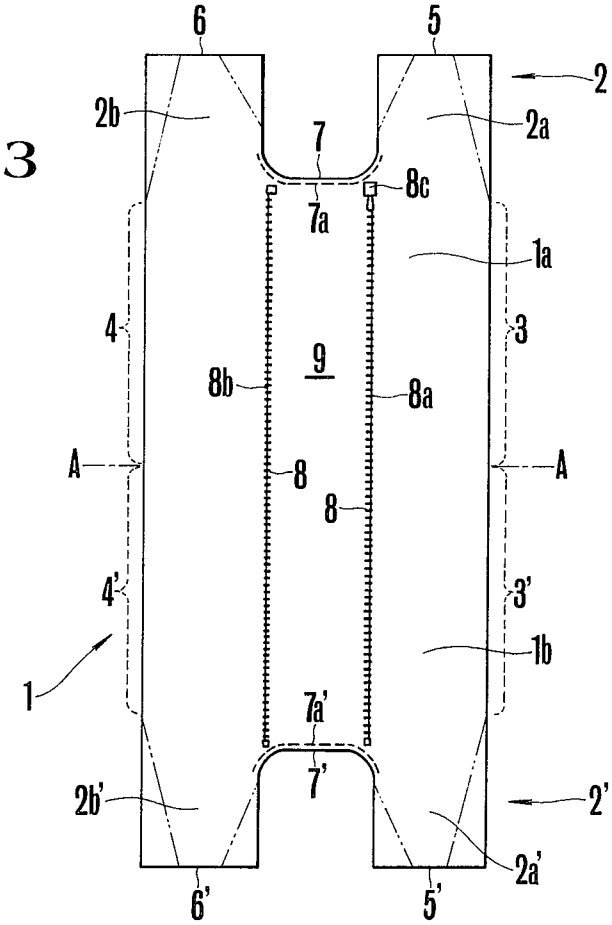
FIG. 3 is a schematical development of a single continuous piece of cloth cut into a predetermined shape to form a utility bag or pouch according to another embodiment of the present invention, showing the condition before sewing.

FIGS. 3 and 4 show another embodiment of the present invention. In this example, the mounting position of the fastener 8 is changed from that in the case of the above-mentioned embodiment shown in FIGS. 1 to 2, thereby to increase the adjustable range of the capacity of the body 1 or the article-holding section. As in the case of the embodiment shown in FIGS. 1 to 2*a*, a single continuous seamless piece of cloth is cut so that the portions corresponding to the front and rear sides 1*a* and 1*b* of the body 1 and those corresponding to the grips 2 and 2' are provided symmetrically with respect to the line A—A on the portion corresponding to the bottom side of the body 1. In this embodiment, however, a pair of parallel tapes 8*a* and 8*b* having interlocking teeth for slide fastener 8 and spaced apart by a predetermined distance are sewn directly on the surface of the cloth in the longitudinal direction of the central portion of the body 1 throughout substantially the entire length from the front side 1*a* to the rear side 1*b* through the bottom portion. The tapes 8*a* and 8*b* having interlocking teeth are engaged with each other by a slider 8c by folding inward a portion 9 between the tapes 8a and 8b. In this case, the fastener 8 is preferably of the type in which the slider 8c can engage and disengage the tapes at the lower stopper.

After mounting the fastener 8, elastic cords 7a and 7a' are sewn in the body 1 as in the case of the first embodiment shown in FIGS. 1 and 2. After sewing and reversing, the fastener 8 is made to close (in a half-open state, in FIG. 4). Thus the utility bag or pouch is formed as shown in FIG. 4.

Figure 5:
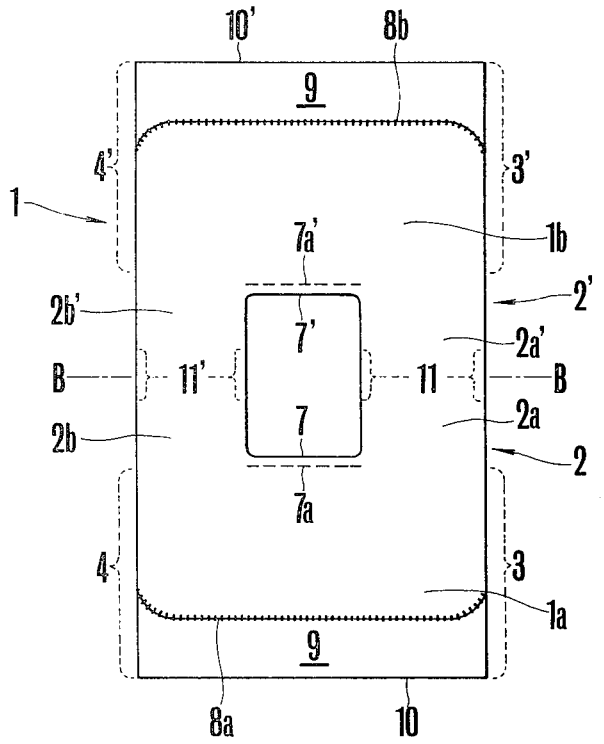
FIG. 5 is a schematical development of a single continuous piece of cloth cut into a predetermined shape to form a utility bag or pouch according to still another embodiment of the present invention, showing the condition before sewing.
Figure 6:
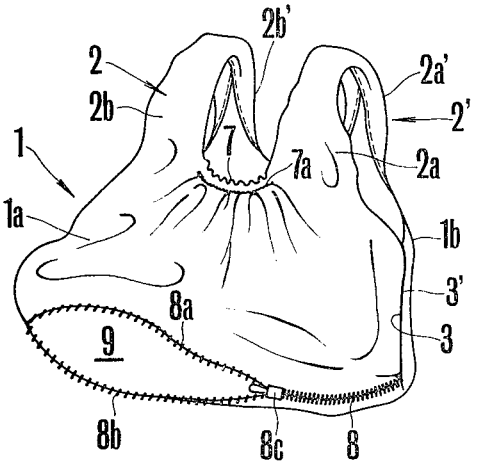
FIG. 6 is a perspective view of a utility bag or pouch formed by sewing the material shown in FIG. 5, showing the fastener as it appear when half opened.
Figure 6A:
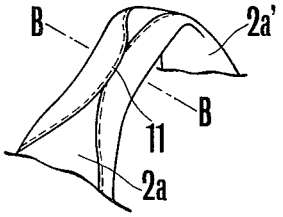
FIG. 6*a* is a perspective view showing the reversed side of the grip of the bag or pouch shown in FIG. 6 in order to illustrate the sewing condition of the rear surface.

FIGS. 5 to 6a show still another preferred embodiment of the present invention. As shown in FIG. 5, a single continuous seamless piece of cloth is cut into a predetermined shape so that it has portions corresponding to the front side 1a and rear side 1b of the body 1 and pairs of extensions 2a, 2b and 2a', 2b' corresponding to grips 2 and 2' formed integrally with the portions 1a and 1b respectively by cutting the central area of the grip portions of the cloth into a U shape (shown as a rectangular hole in FIG. 5), the portions corresponding to the front and rear sides 1a and 1b of the body 1 and the pairs of extensions 2a, 2b and 2a', 2b' corresponding to the grips 2 and 2' being provided symmetrically wih respect to the line B—B corresponding to the top edge portions of the grips 2 and 2'. In this case, reference numerals 10 and 10' designate portions corresponding to the bottom edges of the body 1. The front side portion 1a, rear side portion 1b, grip portions 2 and 2' thus provided symmetrically with respect to the line B—B are folded back with their front surfaces facing each other along the line B—B. Then the side edge 3 of the front side portion 1a and the side edge 3' of the rear side portion 1b are sewn together, and the side edge 4 of the front side portion 1a and the side edge 4' of the rear side portion 1b are also sewn together. In addition, the bottom edges 10 and 10' of the body 1 are sewn together.

Prior to the above process, as with the above-mentioned two embodiments, margins to sew up are provided at the edges of the cloth except the above seams. Elastic cords 7a and 7a' are preferably sewn in the bottom portion 7 and 7' (i.e., the bottom edges of the opening of the pouch) of the U-shaped cuts, respectively, thereby causing the bottom edges of the opening to be normally shrunk.

In order to increase the handiness and strength of the grips 2 and 2', they may be sewn in the following manner:

Areas 11 and 11' having a suitable width on the side edges of the top portions of the grips 2 and 2' formed of the extensions 2a, 2a' L and 2b, 2b' respectively are sewn together so as to make the grips 2 and 2' doublelayered. FIG. 6a shows the reversed side of the grip in order to illustrate the sewing condition of the grip.

Prior to sewing of the edges 3, 3' and 4, 4' of the front side portion 1a and rear side portion 1b of the body 1, in this embodiment, a pair of tapes 8a and 8b having interlocking teeth for a slide fastener 8 are sewn directly on the surface of the cloth so that they are parallel with the bottom edge portions 10 and 10' and spaced therefrom by a predetermined distance throughout substantially the entire length, respectively. As with the above-mentioned embodiments, the tapes 8a and 8b of the fastener 8 may be engaged with each other using a slider 8c, after completion of the bag, by folding inward a portion 9 formed therebetween at the bottom of the body 1.

As with the previously mentioned, the semi-product thus formed is reversed and the fastener is made to close (in a half-open state, in FIG. 6). Thus the utility bag or pouch of the present invention is formed as shown in FIG. 6. In this embodiment, sewn together are not the top edges of the grips but the bottom edges of the body contrary to the embodiments shown in FIGS. 1 to 4.

According to the utility bag or pouch of the present invention as in the above-mentioned, its grips and body are formed of a single continuous piece of cloth or the like and therefore, unlike the conventional one, it is not liable to damage at the portions where the grips join the body, even when it carries heavy articles. According to the present invention, the capacity of the bag can be adjusted by operating the slide fastener. In addition, a collapsible umbrella or the like can be held in a small compartment to be formed inside the body of the bag when the fastener is closed. Furthermore, since the utility bag or pouch of the present invention can be produced in a very simplified process using a single continuous piece of cloth or the like, the bag thus produced is more strong and inexpensive than the conventional one even when the same material is used. When a variety of forms of bags are required in consideration of a sense of beauty, only the changes of the cutting size of the cloth are enough for the purpose. Moreoever, the fastener can be easily mounted on the cloth as mentioned above. The utility bag or pouch of the present invention may of course be folded up in a compact form so as to be held in a pocket or the like when not in use.

While specific embodiments of the invention have been shown and described in detail to illustrate the application of the principles of the invention, it will be understood that the invention may be embodied otherwise without departing from such principles.

What is claimed is:

1. A utility bag for holding articles comprising a sheet of material including a first side wall and a second side wall, each side wall having two side edges, said first and second side wall being in juxtaposition, a lower part of each side edge of said first side wall and a substantially equal length of a juxtaposed lower part of each side edge of said second side wall being sewably connected, a remaining upper part of each side edge of said first and second side walls being disposed adjacent to a portion of said material, said material having a cutout centrally disposed between said material portions, at least two of said material portions being connected to each other forming loops defining hand grip areas, a plurality of tapes, each of said tapes having an interlockable member sewn to a respective one of said side walls, means connected to at least one of said members for interlocking both members, and an integral part of said material disposed between said tapes providing means for adjusting the capacity of said bag.

2. A utility bag according to claim 1, wherein each of said side walls has a cutout intermediate said portions of said material adjacent each side edge.

3. A utility bag according to claim 2, said portions of said material adjacent each side edge of said first wall being sewably connected to each other, and the portions of said material adjacent each side edge of said second side wall being sewably connected to each other.

4. A utility bag according to claim 2, the portions of said material adjacent each side edge of said first wall being sewably connected to juxtaposed portions of said material adjacent each side edge of said second wall.

5. A utility bag according to claim 2, further comprising elastic means sewably connected to said material adjacent to said cutout.

6. A bag-forming blank comprising a single sheet of material having a first side wall forming panel and a second side wall forming panel, said first panel being integrally interconnected to said second panel, each of said panels having an end edge and two side edges, said material having at least one cutout centrally disposed intermediate side portions of said material adjacent to said side edges and at least one end portion of said material adjacent to one of said end edges, said side portions of material defining handle grip forming members, zipper means sewn to at least one of said panels, said blank being adapted to be converted into a bag having a body for holding articles and a pair of integral handle grips by folding said sheet, juxtaposing said side wall forming panels, sewing together parts of said juxtaposed side wall forming panels not adjacent to the side material portions and sewing together at least part of said side material portions.

* * * * *